US006506028B2

(12) United States Patent
Silveira et al.

(10) Patent No.: US 6,506,028 B2
(45) Date of Patent: Jan. 14, 2003

(54) SUCTION MUFFLER FOR A HERMETIC COMPRESSOR

(75) Inventors: Marcio Silveira, Joinville (BR); Edson Corrêa Miguel, Joinville (BR); Fabian Fagotti, Joinville (BR)

(73) Assignee: Empresa Brasileira de Compressores S/A-Embraco, Joinville (BR)

( * ) Notice: Subject to any disclaimer, the term of this patent is extended or adjusted under 35 U.S.C. 154(b) by 0 days.

(21) Appl. No.: 09/938,332

(22) Filed: Aug. 23, 2001

(65) Prior Publication Data

US 2002/0076335 A1 Jun. 20, 2002

Related U.S. Application Data

(63) Continuation of application No. PCT/BR00/00018, filed on Feb. 24, 2000.

(30) Foreign Application Priority Data

Feb. 26, 1999 (BR) ..... 9900463

(51) Int. Cl.[7] ..... F04B 53/00
(52) U.S. Cl. ..... 417/312
(58) Field of Search ..... 417/312, 902; 181/403, 249

(56) References Cited

U.S. PATENT DOCUMENTS 4,960,368 A 10/1990 Lilie ..... 417/312
5,201,640 A 4/1993 Heinzelmann et al. ..... 417/312
5,733,106 A * 3/1998 Lee ..... 181/264
5,804,777 A 9/1998 Kim et al. ..... 181/229
5,971,720 A * 10/1999 Fagotti et al. ..... 181/403
6,017,197 A * 1/2000 Jensen et al. ..... 181/249
6,358,019 B1 * 3/2002 Iversen et al. ..... 181/403

FOREIGN PATENT DOCUMENTS

EP 0 897 060 2/1999 ..... F02M/35/12

* cited by examiner

*Primary Examiner*—Teresa Walberg
*Assistant Examiner*—Vinod D Patel
(74) *Attorney, Agent, or Firm*—Darby & Darby

(57) ABSTRACT

A suction muffler for a hermetic compressor, comprising a hollow body (10,20) provided with gas inlet and gas outlet nozzles (12,22) and, internally, with a plurality of chambers (C1, C2, C3) and a duct (T) having an end connected with and opened to the gas inlet nozzle (12), median windows (45,55), which are longitudinally spaced from each other and opened to respective chambers (C1, C2), and an opposite end opened to a last chamber (C3), which is maintained opened to the gas outlet nozzle (22). The last chamber (C3) is partially divided in two volumes with different shapes and dimensions, the opposite end of the duct (T) projecting to the inside of the last chamber (C3), both the gas outlet nozzle (22) and the opposite end of the duct (T) being opened to the larger volume of the last chamber (C3).

4 Claims, 2 Drawing Sheets

SUCTION MUFFLER FOR A HERMETIC COMPRESSOR

This is a continuation of international application Ser. No. PCT/BR00/00018, filed Feb. 24, 2000, the entire disclosure of which is hereby incorporated by reference.

FIELD OF THE INVENTION

The present invention refers to a suction muffler to be used in the refrigerant gas supply in a hermetic compressor for small refrigeration systems.

BACKGROUND OF THE INVENTION

There are known in the art the suction mufflers constructed in injected plastic material and comprising, basically, a hollow body, which is provided, externally, with gas inlet and gas outlet nozzles and, internally, with a plurality of chambers and a duct having an end connected with and opened to the gas inlet nozzle of the hollow body, median windows, which are longitudinally spaced from each other and opened to respective chambers, and an opposite end opened to a last chamber, which is maintained opened to the gas outlet nozzle of the hollow body.

While conducting to a substantial noise attenuation, these prior art constructive solutions still allow noise to be produced in undesirable levels, which are even unacceptable in determined situations, as a function of a specific frequency that is developed in the last chamber which promotes the fluid communication between the duct, internally provided in the hollow body, and the gas outlet nozzle.

DISCLOSURE OF THE INVENTION

It is a general objective of the present invention to provide a suction muffler of the type considered herein, which allows to attenuate the noise produced in the last chamber of the hollow body, without however creating a complicating factor in the construction of the muffler or causing a relevant suction head loss.

The suction muffler of the present invention, comprising the basic elements mentioned above, allows the objective proposed herein to be achieved, by the fact that the last chamber is partially divided in two volumes with different shapes and sizes, by means of a deflecting wall occupying a substantial part of the height of the last chamber from a wall thereof opposite to that in which is provided the gas outlet nozzle, the opposite end of the duct projecting into the last chamber by an extension not greater than the height of the deflecting wall, both the gas outlet nozzle and the opposite end of the duct being opened to the larger volume of the last chamber, in opposite walls of the latter and in mutually offset positions. The construction defined above allows the acoustic mode developed in the last chamber to be attenuated, obtaining a shorter wavelength and a higher frequency, which becomes acoustically irrelevant. Thus, it is obtained a reduction in the level of the noise produced by the compressor.

BRIEF DESCRIPTION OF THE DRAWINGS

The invention will be described below, with reference to the attached drawings, in which.

BEST MODE OF CARRYING OUT THE INVENTION

Figure 1:
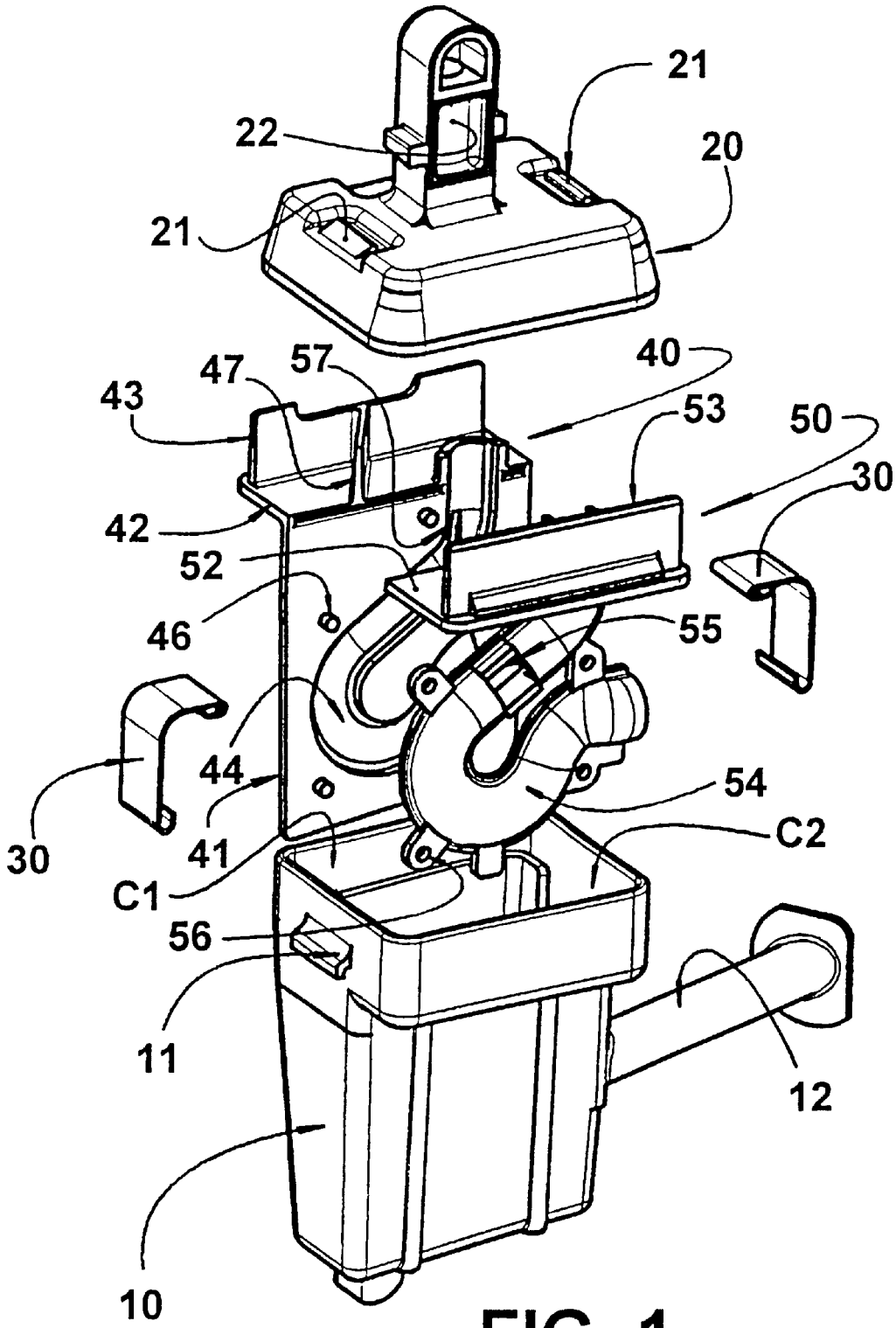
FIG. 1 is an exploded perspective view of a possible construction for the suction muffler of the present invention.

As illustrated in the appended drawings, the suction muffler of the present invention comprises a hollow body, which is usually obtained in injected plastic material and which comprises a basic cup 10 with a usually rectangular cross section and an upper cap 20, which is seatable onto the upper edge of the basic cup 10 and affixed thereto by any adequate means, such as for example, a pair of clamps 30, which are fitted by elastic deformation, into respective ears 11 and 21 provided both in the basic cup 10 and in the cap 20. The basic cup 10 incorporates, laterally, a gas inlet nozzle 12 which, in the illustrated embodiment, takes the form of a tubular extension, whose free end is designed to be aligned with the suction inlet tube provided through the hermetic shell of the compressor (not illustrated). The cap 20 incorporates, superiorly and externally, a gas outlet nozzle 22, also in the form of a tubular extension, with the free end thereof designed to be adapted to the suction orifice of a valve plate (not illustrated) of the head of the hermetic compressor.

Figure 3:
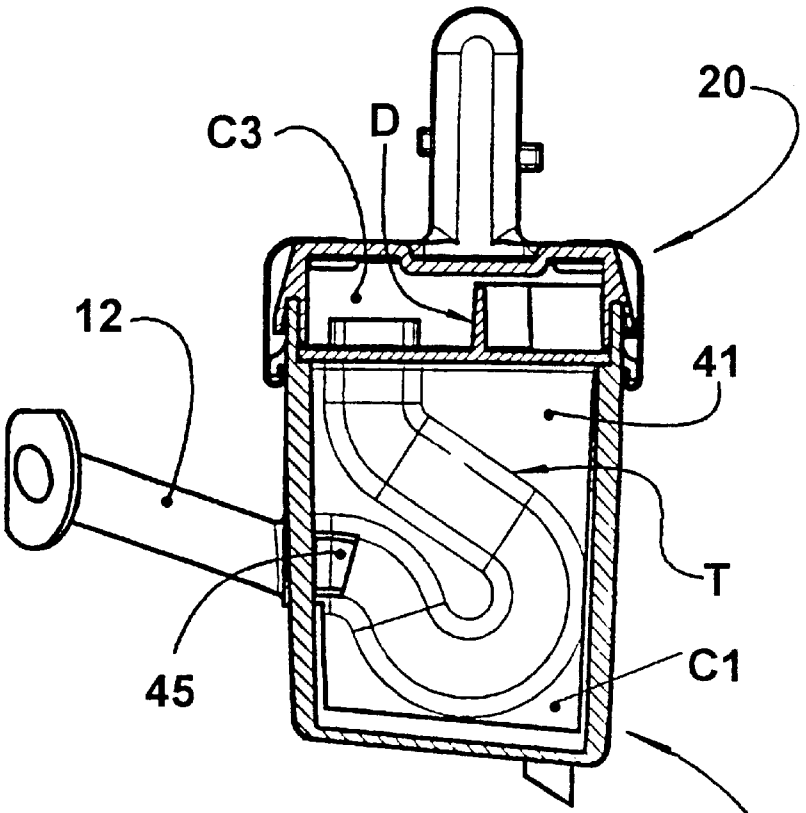
FIG. 3 is a vertical cross-sectional view of the suction muffler, taken according to line III—III of FIG. 2.
Figure 2:
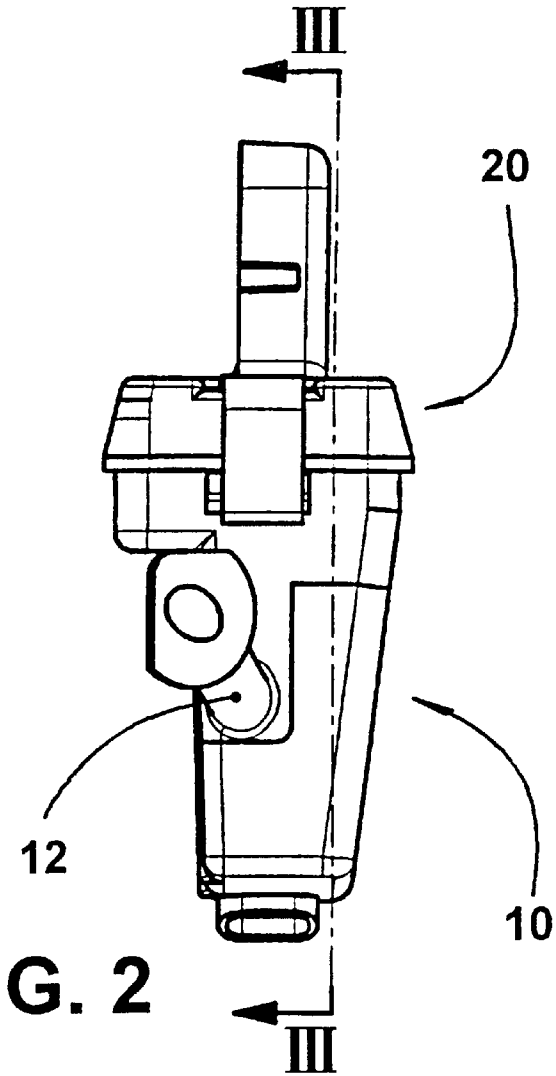
FIG. 2 is a lateral elevational view of the suction muffler of FIG. 1 in the finished condition.

In the illustrated construction, the internal division of the suction muffler is obtained by a pair of inserts 40 and 50 in plastic material, the first insert 40 being defined by a vertical plate 41 designed to divide the basic cup 10 in a first chamber C1 and a second chamber C2, provided side by side and extending from the bottom of the basic cup 10, up to a level which is lowered in relation to the upper edge of the latter. The vertical plate 41 incorporates, superiorly, a lateral flange 42, which is designed to define the upper wall portion of the first chamber C1, having its free peripheral edge seated onto a respective inner step of the basic cup, as illustrated in FIG. 3. The lateral flange 42 incorporates, in its edge opposite to that one which is joined to the vertical plate 41, an upper lateral wall portion 43 positioned internally to a corresponding lateral skirt portion of the cap 20.

The first insert 40 has its vertical plate 41 incorporating a recess 44, which is projected to the inside of the first chamber C1, with a semi-circular cross section, in the form of a semi-tubular duct extending along a curved path from an edge of the vertical plate 41, in order to be kept aligned and opened in relation to a respective half part of the gas inlet nozzle 12, until surpassing the lateral flange 42 in its opposite end.

The second insert 50 is defined by a horizontal plate 52, which is designed to seat onto an internal step of the basic cup 10, in the same level of the lateral flange 42, completing, with the latter, the cross section of the basic cup 10 and defining the upper wall of the second chamber C2. This horizontal plate 52 incorporates, inferiorly and in a plane parallel to that of the vertical plate 41, an extension of a semi-tubular duct 54, which is designed to be seated against the recess 44 of the vertical plate 41, in order to form a duct T, which is curved and has an end connected with and opened to the gas inlet nozzle 12 and with the opposite end projecting beyond the upper wall of the first chamber C1 and second chamber C2, as explained below. The horizontal plate 52 also incorporates, in the illustrated embodiment, an upper lateral wall 53 positioned inside a respective peripheral skirt portion of the cap 20.

In order that the first chamber C1 and the second chamber C2 operate attenuating noise, the duct T has a first lateral window 45 provided in the area defined by the recess 44 and opened to the inside of the first chamber C1, and a second lateral window 55, provided in the extension of the semi-tubular duct 54.

As illustrated in FIG. 1, the vertical plate 41 incorporates small salient lateral pins 46 to be fitted and affixed into respective holes of ears 56 incorporated to the extension of the semi-tubular duct 54.

A third chamber C3 is defined in the upper part of the basic cup 10 between the cap 20 and a bottom wall which also constitutes the upper walls of the first and the second chambers C1 and C2, said walls being formed, respectively, by the lateral flange 42 of the first insert 40 and by the horizontal plate 52 of the second insert 50.

According to the invention, the third chamber C3 is partially divided in two volumes of different shapes and dimensions, by means of a deflecting wall D occupying a substantial part of the height of the third chamber C3, from its bottom wall 42, 52 adjacent to the first and the second chamber C1 and C2. Preferably, the deflecting wall D has a height of about ½ to ¾ the height of the third chamber C3, being provided in a substantial diagonal arrangement, so that, both the opposite end of the duct T and the gas outlet nozzle 22 be positioned in the larger volume of said third chamber.

The dividing wall D consists of two upper vertical flanges 47 and 57, which are respectively incorporated to the lateral flange 42 of the first insert 40 and to the horizontal plate 52 of the second insert 50.

Also according to the invention, the opposite end of the duct T is designed to project to the inside of the third chamber C3 by an extension not greater than the height of the deflecting wall D. Preferably, the duct T is projected to the inside of the third chamber C3 by an extension from about ⅓ to ½ the height of said chamber.

Another aspect to be observed is that the opposite end of the duct T and the gas outlet nozzle 22 are provided in opposite walls of the third chamber C3, in mutually offset positions.

While an embodiment of a suction muffler comprising three chambers has been described herein, it should be understood that the invention may also be applied to the last chamber of noise attenuation, which is adjacent to the gas outlet opened to the valve plate of the compressor, when associated to a variable number of first chambers, as a function of the muffler design.

What is claimed is:

1. A suction muffler for a hermetic compressor, comprising a hollow body (10,20) provided, externally, with gas inlet and gas outlet nozzles (12,22) and, internally, with a plurality of chambers (C1, C2, C3) and a duct (T) having an end connected with and opened to the gas inlet nozzle (12), median windows (45,55), which are longitudinally spaced from each other and opened to respective chambers (C1, C2), and an opposite end opened to a last chamber (C3), which is maintained opened to the gas outlet nozzle (22), wherein the last chamber (C3) is partially divided in two volumes, with different shapes and dimensions, by a deflecting wall (D) occupying a substantial part of the height of the last chamber (C3) from a bottom wall (42,52) thereof opposite to that in which is provided the gas outlet nozzle (22), the opposite end of the duct (T) projecting to the inside of the last chamber (C3), through said bottom wall (42,52) thereof, by an extension not greater than the height of the deflecting wall (D), both the gas outlet nozzle (22) and the opposite end of the duct (T) being opened to the larger volume of the last chamber (C3), in mutually offset positions.

2. Suction muffler, according to claim 1, wherein the height of the deflecting wall (D) is from about ½ to ¾ the height of the last chamber (C3).

3. Suction muffler, according to claim 1, wherein the duct (T) is projected into the last chamber (C3) by an extension from about ⅓ to ½ the adequate height.

4. Suction muffler, according to claim 1, wherein the deflecting plate (D) is provided in a diagonal arrangement in relation to the cross section of the hollow body (10,20).

* * * * *